US006173785B1

(12) United States Patent
Adams et al.

(10) Patent No.: US 6,173,785 B1
(45) Date of Patent: Jan. 16, 2001

(54) PRESSURE-BALANCED ROD PISTON CONTROL SYSTEM FOR A SUBSURFACE SAFETY VALVE

(75) Inventors: Jeffrey K. Adams; James Allison, both of Broken Arrow, OK (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/173,515

(22) Filed: Oct. 15, 1998

(51) Int. Cl.[7] ..... E21B 34/10

(52) U.S. Cl. ..... 166/375; 166/332.8; 166/383; 166/386; 137/312; 251/281

(58) Field of Search ..... 166/332.8, 334.1, 166/375, 383, 386; 137/312; 251/281

(56) References Cited

U.S. PATENT DOCUMENTS

| | | | | |
|---|---|---|---|---|
| 3,696,868 | * | 10/1972 | Taylor, Jr. | 166/375 |
| 4,252,197 | * | 2/1981 | Pringle | 166/324 X |
| 4,448,254 | * | 5/1984 | Barrington | 166/373 |
| 4,676,307 | * | 6/1987 | Pringle | 166/322 |
| 5,251,702 | * | 10/1993 | Vazquez | 166/375 X |
| 5,415,237 | * | 5/1995 | Strattan | 166/375 |
| 5,564,501 | * | 10/1996 | Strattan et al. | 166/375 |
| 5,906,220 | * | 5/1999 | Thompson | 166/375 X |
| 6,003,605 | * | 12/1999 | Dickson et al. | 166/375 |

FOREIGN PATENT DOCUMENTS

| | | |
|---|---|---|
| 2147643 | 5/1985 | (GB) . |
| 2163793 | 3/1986 | (GB) . |
| 2172036 | 9/1986 | (GB) . |
| 2301383 | 12/1996 | (GB) . |

OTHER PUBLICATIONS

Camco Products & Services Brochure, The Deepwater Specialist, 8 pages, 1997.

* cited by examiner

*Primary Examiner*—George Suchfield
(74) *Attorney, Agent, or Firm*—Duane, Morris & Heckscher LLP

(57) ABSTRACT

A control system for a subsurface safety valve (SSV) comprising of a control line from the surface in fluid communication with the top side of an actuating piston which moves a flow tube downwardly to open the SSV. A balance line runs from the surface to the bottom side of the same actuating piston to put the actuating piston in pressure balance. A buildup of pressure in the control line overcomes a return spring to open the valve, while removal of pressure from the control line allows the return spring to close the valve. Seals and leakpaths are provided through the actuating piston so that, depending on the hydrostatic pressure in the control line and the size of the return spring, the various failure modes of the actuating piston seals and control line or balance line will preferentially result in a fail-closed situation in the SSV.

18 Claims, 1 Drawing Sheet

PRESSURE-BALANCED ROD PISTON CONTROL SYSTEM FOR A SUBSURFACE SAFETY VALVE

FIELD OF THE INVENTION

The field of this invention relates to control systems for downhole equipment, particularly subsurface safety valves (SSVs).

BACKGROUND OF THE INVENTION

Typically, production strings in wells have an SSV which is controlled from the surface. The SSV is typically a spring-loaded flapper which is pushed into the open position by downward movement of an open tube called the "flow tube." The flow tube is actuated by an actuating piston which is, in turn, a part of a control circuit for selective opening and closing of the SSV from the surface of the well. Many different designs have been used in the past to control the opening and closing of the SSV. Typically, a control line is run from the surface to the actuating piston and a return spring acts on the actuating piston in a direction opposite the hydrostatic force put on the piston by the column of fluid in the control line to the surface. The piston is typically an annular shape or it can have a cylindrical or rod shape. The spring is made sufficiently stiff so as to withstand the anticipated hydrostatic force for the depth to which the valve is to be installed. Yet other designs have included pressurized gas chambers which act on the backside of the actuating piston to resist the hydrostatic pressures anticipated in the control line. The pressurized gas chambers contain oil so that the actuating piston seals are lubricated.

Annularly shaped pistons have been waning in popularity due to the numerous seals required, all of which increase the prospects for leakage and malfunctioning of the valve. Another main concern of any design for a control system for an SSV is the failure mode if certain seals malfunction. It is important to have failsafe operation of the SSV and, thus, the fewer situations that can arise where the valve fails open, the more desirable is the control system design and the valve which goes with it.

Some designs in the past have used pressure-balancing between the top side and bottom side of the actuating piston, coupled with fairly complex shuttle valving to allow for normal operation of the valve between an open and closed position. While use of the concept of pressure-balancing has enabled a significant reduction in the size of the return spring, other complications introduced into the system to make such a design operable have created a new set of operational issues, detracting from the desirability of the equalizing-type designs which use a complex shuttle valve. What is yet to be developed and what is an object of this invention is to provide a simple design which has minimal possibilities for fail-open operation and which is simple to build and install and reliable to operate.

Some of the patents which illustrate the prior designs discussed above are U.S. Pat. Nos. 5,564,501 and 4,676,307. Also of general interest in the area of SSV control systems are U.S. Pat. Nos. 4,252,197 and 4,448,254.

Accordingly, one of the objects of the present invention is to provide a control system where the actuating piston, which is a rod type, is in pressure balance. In combination with this objective, which is accomplished by the provision of a balance line to the surface, the actuating piston is configured in such a way so as to meet the objective of the invention of minimizing, and in certain situations eliminating, fail-open modes of the valve. These and other objectives will become apparent to one skilled in the art from a review of the preferred embodiment described below.

SUMMARY OF THE INVENTION

A control system for an SSV is disclosed. A control line from the surface is in fluid communication with the top side of an actuating piston which moves a flow tube downwardly to open the SSV. A balance line runs from the surface to the bottom side of the same actuating piston to put the actuating piston in pressure balance. A buildup of pressure in the control line overcomes a return spring to open the valve, while removal of pressure from the control line allows the return spring to close the valve. Seals and leakpaths are provided through the actuating piston so that, depending on the hydrostatic pressure in the control line and the size of the return spring, the various failure modes of the actuating piston seals and control line or balance line will preferentially result in a fail-closed situation in the SSV.

DETAILED DESCRIPTION OF THE PREFERRED EMBODIMENT

Figure 1:
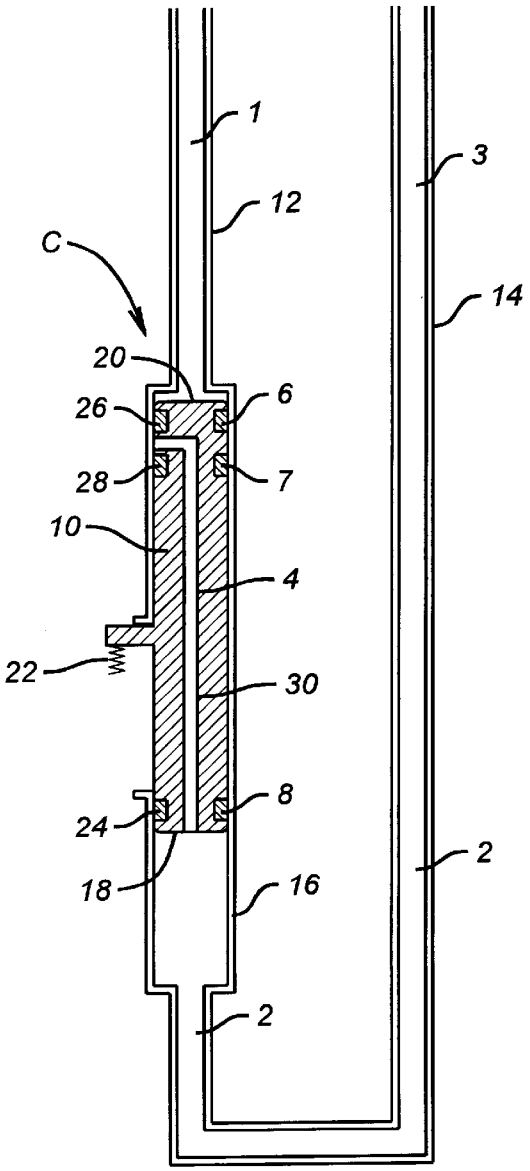
FIG. 1 is a schematic representation of the control system of the present invention, shown with the valve in the closed position.
Figure 2:
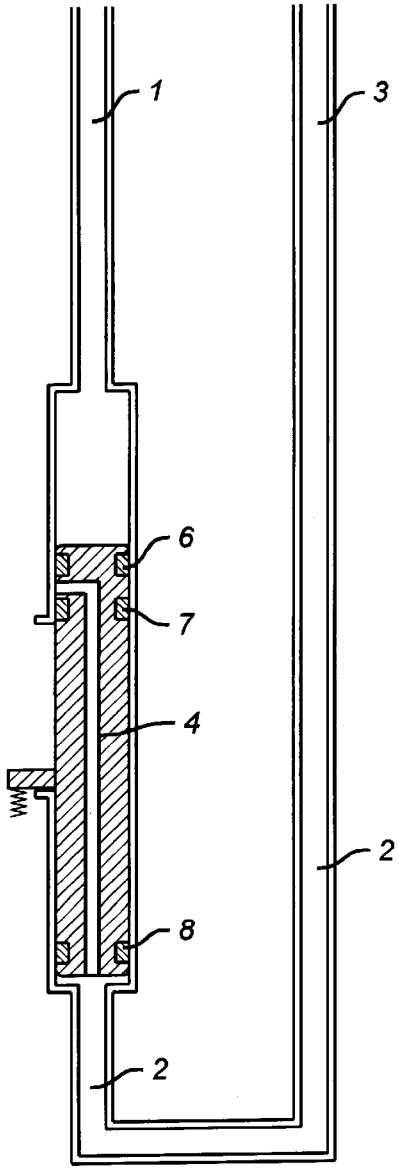
FIG. 2 is the view of FIG. 1, with the SSV shown in the open position.

FIGS. 1 and 2 illustrate a control system C for an SSV. Omitted for clarity are the tubing in which the SSV is mounted, as well as the SSV flapper and flow tube. Those skilled in the art are familiar with installation of tubing-retrievable safety valves and the basics of their operation. Those basics include a flapper with a matching seat and a reciprocating flow tube which is actuated by an actuating piston 10. In the preferred embodiment, the actuating piston 10 of the present invention is connected to a control line 12 which runs from the location of the SSV to the surface (not shown). The piston 10 is a "rod" piston which is defined as a piston whose diameter is smaller than the wall thickness of the housing. This would exclude an annular piston. A balance line 14 also runs from the area of the SSV to the surface. Balance line 14 is connected to housing 16 at a point below the lower end 18 of piston 10. Since there is a hydrostatic column of control fluid in the control line 12 and an essentially equal column of the identical control fluid in balance line 14, the cylindrically shaped piston 10, which has identical diameters at its lower end 18 and upper end 20, is in pressure balance from the control fluids in lines 12 and 14. A return spring 22 operates on actuating piston 10 through an opening in the housing 16.

Actuating piston 10 has a lower seal 24 and a pair of upper seals 26 and 28. An internal passage 30 extends from lower end 18 to between seals 26 and 28.

The normal operation of the control system C to open the SSV simply requires build-up of pressure in control line 12 to overcome the resistance of return spring 22. This will push actuating piston 10 downwardly to the position shown in FIG. 2, which will, in turn, push the flow tube (not shown) downwardly to rotate the flapper (not shown) 90° to the open position. Normal closure of the SSV requires removal of applied pressure in the control line 12, which will allow the return spring 22 to push the actuating piston 10 upwardly, returning it from the position shown in FIG. 2 to the position shown in FIG. 1. Upward movement of the actuating piston 10 will allow the flow tube (not shown) to move upwardly and will, in turn, allow the spring (not shown) attached to the flapper (not shown) to swing the flapper 90° to contact the seat (not shown) for closure of the SSV.

Various failure modes of the control system will now be described. A leak from the control line 12 to the annulus, with pressure being applied to the control line 12, can occur. It can also occur when the hydrostatic pressure in the control line 12 exceeds the hydrostatic pressure in the annulus without pressure applied to control line 12. The resulting loss of pressure from the control line 12 in this situation will close the SSV by allowing the spring 22 to shift to piston 10.

A leak can occur from the balance line 14 into the flow tube around seals 24 or 28. This kind of leakage can occur when the hydrostatic pressure in the balance line 14 exceeds the pressure in the flow tube. Such leakage can reduce the hydrostatic pressure in the balance line 14 since the hydrostatic pressure in the control line 12 becomes greater than the hydrostatic pressure in the balance line 14. The power spring 22 must be sized strong enough to overcome the maximum pressure differential experienced by the piston 10. If it is sized appropriately, return spring 22 will shift the piston 10 to close the SSV. If the return spring 22 in this situation is sized for a force less than the hydrostatic force on piston 10 from control line 12, then the SSV will fail open.

Conversely to the above situation, a leak can occur into the balance line 14 around seals 24 or 28 if the pressure in the flow tube exceeds the hydrostatic pressure in the balance line 14. In this situation where leakage occurs past seals 24 or 28 into the balance line 14, a low hydrostatic pressure can occur in the balance line 14, particularly if the application is in a gas well. The gas coming into the balance line 14 will displace the heavier fluid and reduce the hydrostatic pressure, thus potentially putting the valve in a fail-open situation unless the return spring 22 is sized sufficiently strong to overcome the hydrostatic weight and friction forces acting on piston 10.

The balance line 14 can leak into the annulus if the annulus is at a lower pressure than the hydrostatic pressure in the balance line 14. Again, with a reduction in the hydrostatic force in the balance line 14, whether the valve fails open or closed is dependent on the sizing of the return spring 22. If the return spring 22 is sufficiently strong to overcome hydrostatic forces from the control line 12, as well as frictional and weight forces on the piston 10, the valve will fail closed. Otherwise, it will fail open.

Seal 26 can fail. If it does, there's normally no flow across it unless pressure is applied to the control line 12. The reason for this is that, because of the presence of the balance line 14, there is no differential across seal 26 until the pressure is elevated in control line 12 at the surface. Once that occurs, the leakage past seal 26 will commence through passage 30 which will tend to equalize pressure on both sides of piston 10, which allow the valve to fail closed.

Those skilled in the art will appreciate that there are numerous circumstances of well pressure conditions which will affect the nature of the failure of the SSV when a particular portion of the control system C fails. In general, if the return spring 22 is sized to close the valve against hydrostatic of the control line 12 and friction and weight acting on piston 10, the SSV will fail closed in all situations of loss of seals 24, 26, and 28. A weaker spring 22 will result in some fail open situations as described above.

One of the advantages of the control system C of the present invention is that it is insensitive to the setting depth of the SSV. The return spring 22 can be sized for frictional and weight loads on the piston 10 independent of setting depth. By use of the balance line 14, significant pressures in the control line 12 at the surface are unnecessary in order to open the valve. Many hydraulic systems available at the surface have upper operating limits, such as less than 5000 psi. With the balance line 14, a stiffer return spring 22 can be used without exceeding the capacity of the surface equipment which would be required to open the valve.

Those skilled in the art can appreciate that the piston 10 in housing 16 is in pressure balance from the tubing pressure and, thus, is insensitive to the shut-in tubing pressure which may exist in the well.

In certain situations where there may be extreme sand or paraffin in the tubing, the balance line 14 can be used to assist in closing the valve by applying pressure to the balance line 14 from the surface equipment. The construction of the control system as illustrated in FIGS. 1 and 2 is substantially simpler than designs involving internal gas chambers acting on hydraulic fluid in order to resist the hydrostatic from the control line 12. With the presence of control line 12 and balance line 14, special constructions of the SSV which involve access into an annular chamber which is part of the control system C are not required. In some designs as a backup, access was required into the control system so that if the tubing-retrievable safety valve failed to operate, a wireline-type valve could be installed on a landing nipple and still be controlled from access to the control system C. This technique involved penetrating the wall into an annular chamber to obtain access to the control line pressure in line 12. This technique is illustrated in U.S. Pat. No. 5,799,949. In the control system C of the present invention, the connections on the SSV body required to provide this annular chamber can be eliminated. The presence of the balance line 14 adds additional assurances in being able to close the valve if necessary. Additionally, backup lines to control line 12 can also be installed for additional security if one of them should happen to be damaged; however, redundancy in the control lines becomes more problematic with the addition of the extra line 14 which acts as the balance line. Additionally, depending on the stiffness of the return spring 22, certain failure modes as described above may result in a fail-open situation.

In the preferred embodiment, the piston 10 is a rod piston, with the passage 30 extending from the lower end 18 to between two seals 26 and 28 adjacent the upper end 20. The configuration shown in FIGS. 1 and 2 for the seals 26, 28, and 24, as well as passage 30, can be flipped over; however, the preferred embodiment is as shown in FIGS. 1 and 2 because fewer failure modes can result in a fail-open situation in the configuration as shown in FIGS. 1 and 2. By putting the piston 10 in pressure balance, it makes it easier to use a rod piston which is the preferred shape for piston 10. With a rod piston, the seals 24, 26, and 28 are smaller and the overall design of the SSV is simpler to manufacture. With the balanced design of the control system C as shown, a fully fail-safe closed operation can be obtained, with surface equipment limited to 5000 psi by the use of a return spring 22, which can be overcome with pressures of 5000 psi or less at the surface. As previously stated, the hydrostatic effects are eliminated with the use of the balance line 14.

The foregoing disclosure and description of the invention are illustrative and explanatory thereof, and various changes in the size, shape and materials, as well as in the details of the illustrated construction, may be made without departing from the spirit of the invention.

What is claimed is:

1. A control system for control of a subsurface safety valve (SSV) for movement of a flow tube therein, comprising:

an actuating cylindrically shaped rod piston, sealingly mounted using a plurality of seals in a housing, one of said piston or said housing being operably connected to the flow tube;

a control line from said housing to the well surface, said control line in fluid communication with a first end of said piston;

a balance line extending from the surface to a second side of said piston, putting said piston in pressure balance with hydrostatic pressure from said control line.

2. The system of claim 1, wherein:

said piston is connected to the flow tube.

3. The system of claim 2, further comprising:

a biasing member acting on said piston;

said piston movable from a first position under the bias of said biasing member, where the SSV is closed, to a second position where the force from said biasing member is overcome by applied pressure in said control line to open the SSV.

4. A control system for control of a subsurface safety valve (SSV) for movement of a flow tube therein, comprising: an actuating cylindrically shaped rod piston, sealingly mounted using a plurality of seals in a housing, one of said piston or said housing being operably connected to the flow tube;

a control line from said housing to the well surface, said control line in fluid communication with a first end of said piston;

a balance line extending from the surface to a second side of said piston, putting said piston in pressure balance with hydrostatic pressure from said control line;

said piston is connected to the flow tube;

a biasing member acting on said piston;

said piston movable from a first position where the force from said biasing member is overcome by applied pressure in said control line to open the SSV;

said housing defines an opening through which said piston is operably connected to the flow tube;

said piston comprising a passage therein to direct leakage flow therethrough in the event of failure of at least one of said seals.

5. The system of claim 4, wherein:

said piston comprises a pair of spaced seals adjacent said first end and at least one seal adjacent said second end;

said passage extends from between said spaced seals to said second end of said piston.

6. The system of claim 5, wherein:

said biasing member comprises a spring which exerts a force on said piston toward said piston's first position which exceeds the hydrostatic force in said control line and the weight and frictional forces acting on or through said piston;

whereupon failure of any of said seals, said piston is forced to its said first position.

7. The system of claim 5, wherein:

said biasing member comprises a return spring which can be overcome with an applied pressure in said control line of less than 5000 psi.

8. A method of controlling a subsurface safety valve SSV having a flow tube actuating a flapper and a cylindrical rod piston operatively connected to the flow tube, comprising:

mounting said cylindrical rod piston in a housing which is formed having an opening;

operatively connecting said cylindrical piston to said flow tube through said opening;

providing seals between said piston and said housing;

isolating pressures in said flow tube from said housing with said seals;

actuating said piston to move in a first direction by a control line from the surface;

balancing the hydrostatic forces on said piston from said control line with a balance line to the surface.

9. A method of controlling a subsurface safety valve SSV having a flow tube actuating a flapper and a cylindrical rod piston operatively connecting to the flow tube, comprising:

mounting said cylindrical piston in a housing which is formed having an opening;

operatively connecting said cylindrical piston to said flow tube through said opening;

providing seals between said piston and said housing;

isolating pressures in said flow tube from said housing with said seals;

actuating said piston to move in a first direction by a control line from the surface;

balancing the hydrostatic forces on said piston from said control line with a balance line to the surface;

providing a leakpath through said piston to said balance line;

directing leakage from said flow tube past said seals located above or below said opening to said balance line.

10. The method of claim 9, further comprising:

providing a pair of spaced seals on said piston above said opening, with one being uppermost and the other, lowermost;

running said leakpath from between said spaced seals to a lower end of said piston in communication with said balance line;

providing a lower seal on said piston below said opening and above said lower end of said piston.

11. The method of claim 10, further comprising:

providing a return spring acting on said piston to bias it toward a position where the SSV closes;

sizing said return spring to overcome hydrostatic forces in said control line and weight and frictional forces acting on or through said piston;

allowing said piston to move to a position where the SSV is closed if any of said seals on said piston leak.

12. The method of claim 9, further comprising:

installing the SSV in a well where the fluids passing through the flow tube are at least as dense and at a greater pressure than hydrostatic pressure in said balance line;

using said leakpath as part of the configuration which allows failure of any of said seals to put said piston in a position where the SSV closes.

13. The method of claim 9, further comprising:

pressure-balancing said piston with respect to pressures in the flow tube;

using said leakpath to allow said piston to move to a position where the SSV closes in most all downhole situations where at least one of said seals leaks.

14. The method of claim 10, further comprising:

allowing control line pressure to equalize to said balance line if the uppermost of said spaced seals fails.

15. The method of claim 14, further comprising:

allowing said piston to move to a position where the SSV closes if said control line leaks into the surrounding annulus.

16. The method of claim 15, further comprising:

allowing said piston to move to a position where the SSV closes if fluid from the annulus leaks into said balance line due to annulus pressure being higher than hydrostatic pressure in said balance line.

17. The method of claim 14, further comprising:

allowing the SSV to close as control line pressure leaks past said uppermost seal through said leakpath to equalize pressure on said piston.

18. The method of claim 16, further comprising:

sizing said spring so that said piston can be shifted to open the SSV with control line pressure of less than 5000 psi at the surface.

* * * * *